US009108755B2

(12) United States Patent
Owensby et al.

(10) Patent No.: US 9,108,755 B2
(45) Date of Patent: Aug. 18, 2015

(54) PACKAGE, CONTAINER, ASSEMBLY, AND METHOD FOR CONTAINING A FOOD PRODUCT

(75) Inventors: Joseph E. Owensby, Spartanburg, SC (US); Billy W. Austin, Duncan, SC (US); Howard D. Conner, Mauldin, SC (US); Charles Kannankeril, North Caldwell, NJ (US); Greg E. Harwood, Greenville, SC (US)

(73) Assignee: Cryovac, Inc., Duncan, SC (US)

( * ) Notice: Subject to any disclaimer, the term of this patent is extended or adjusted under 35 U.S.C. 154(b) by 732 days.

(21) Appl. No.: 12/689,873

(22) Filed: Jan. 19, 2010

(65) Prior Publication Data

US 2011/0174870 A1 Jul. 21, 2011

(51) Int. Cl.

| | |
|---|---|
| ***B65D 5/46*** | (2006.01) |
| ***B65B 5/00*** | (2006.01) |
| ***B65B 25/22*** | (2006.01) |
| ***B65D 81/34*** | (2006.01) |
| *B65D 81/26* | (2006.01) |

(52) U.S. Cl.

CPC ..... *B65B 25/22* (2013.01); *B65D 5/46128* (2013.01); *B65D 5/46144* (2013.01); *B65D 81/343* (2013.01); *B65D 81/264* (2013.01); *B65D 81/3453* (2013.01); *B65D 81/3461* (2013.01); *B65D 2581/346* (2013.01)

(58) Field of Classification Search

USPC ..... 229/117.12, 100, 117.35, 903, 119, 229/117.15, 141; 206/549, 193; 426/246, 426/114, 110; 220/368, 495.03

See application file for complete search history.

(56) References Cited

U.S. PATENT DOCUMENTS

| | | | | |
|---|---|---|---|---|
| 1,953,885 | A * | 4/1934 | McAleer | 229/117.15 |
| 2,345,716 | A | 4/1944 | Smith | |
| 2,618,887 | A | 11/1952 | Frankenstein | |
| 2,633,284 | A * | 3/1953 | McFarland et al. | 220/202 |
| 2,755,982 | A | 7/1956 | Vander Lugt, Jr. | |
| 3,166,235 | A | 1/1965 | Schroeder | |
| 3,262,787 | A | 7/1966 | Ellis | |
| 3,905,543 | A | 9/1975 | Randles | |
| 3,941,967 | A * | 3/1976 | Sumi et al. | 219/729 |
| 3,967,998 | A | 7/1976 | Kane | |
| 4,140,889 | A | 2/1979 | Mason, Jr. et al. | |
| 4,173,655 | A | 11/1979 | Capo | |
| 4,449,633 | A | 5/1984 | Johnson et al. | |
| 4,530,459 | A | 7/1985 | Maroszek | |
| 4,584,202 | A | 4/1986 | Roccaforte | |

(Continued)

FOREIGN PATENT DOCUMENTS

| | | |
|---|---|---|
| FR | 2579078 | 9/1986 |
| FR | 2704729 | 11/1994 |

(Continued)

*Primary Examiner* — Gary Elkins
*Assistant Examiner* — Christopher Demeree
(74) *Attorney, Agent, or Firm* — Alston & Bird LLP

(57) ABSTRACT

A package includes a support member and a second support member coupled to a base member. The support members may be configurable between a heating position and a storage position. When in the heating position a recess is positioned below the support members. The package may be part of an assembly further including a flexible container. The flexible container may include a first portion with a food product and a second portion configured to receive liquid byproducts given off by the food product. The second portion of the flexible container may be received in the recess when the assembly is in the heating position.

18 Claims, 9 Drawing Sheets

(56) References Cited

U.S. PATENT DOCUMENTS

| | | | | | |
|---|---|---|---|---|---|
| 4,586,649 | A | * | 5/1986 | Webinger | 229/114 |
| 4,596,713 | A | * | 6/1986 | Burdette | 426/107 |
| 4,780,327 | A | | 10/1988 | Cardner-Carimi et al. | |
| 4,820,536 | A | | 4/1989 | Lippincott et al. | |
| 4,836,383 | A | | 6/1989 | Gordon et al. | |
| 4,984,907 | A | | 1/1991 | Power | |
| 5,002,833 | A | | 3/1991 | Kinsey, Jr. et al. | |
| 5,097,107 | A | * | 3/1992 | Watkins et al. | 219/727 |
| 5,151,568 | A | | 9/1992 | Rippley | |
| 5,167,205 | A | | 12/1992 | Bell et al. | |
| 5,346,312 | A | | 9/1994 | Mabry et al. | |
| 5,565,228 | A | * | 10/1996 | Gics | 426/107 |
| 5,752,605 | A | | 5/1998 | Cooper | |
| 5,843,502 | A | | 12/1998 | Ramesh | |
| 5,857,612 | A | | 1/1999 | Smith et al. | |
| 6,298,983 | B1 | | 10/2001 | Yeager | |
| 7,338,691 | B2 | | 3/2008 | Pollok et al. | |
| 2002/0142078 | A1 | | 10/2002 | Singh | |
| 2002/0185013 | A1 | | 12/2002 | London | |
| 2007/0048421 | A1 | | 3/2007 | Owensby et al. | |
| 2008/0087268 | A1 | | 4/2008 | Burton | |
| 2008/0110353 | A1 | | 5/2008 | Sims | |

FOREIGN PATENT DOCUMENTS

| | | |
|---|---|---|
| GB | 711186 | 6/1954 |
| JP | 60049750 | 3/1985 |
| NL | 8200065 | 8/1983 |

* cited by examiner

PACKAGE, CONTAINER, ASSEMBLY, AND METHOD FOR CONTAINING A FOOD PRODUCT

BACKGROUND OF THE INVENTION

The invention generally relates to flexible containers for food products, such as meat, that give off liquid byproducts, such as grease, during heating, a package for containing a food product that gives off liquid byproducts during heating, and an assembly thereof.

The use of flexible containers, such as ovenable cooking bags, for packaging heated food may provide several benefits. In particular, the flexible containers may simplify the cooking process by providing a convenient way to both store and cook food such that the transportation and cooking of the food is less messy than with conventional methods. Further, the food may be sealed in the bag, such that it may be ensured that the food does not become contaminated during shipping or storage. Additionally, the flexible bags may prevent leakage of grease, water, and other liquid byproducts during heating. Accordingly, cleanup after cooking food in a flexible bag may be substantially simplified as compared to conventional methods. For example, when cooking food in an oven on an oven tray, liquid byproducts emitted from the food may be baked on to the oven tray and then may be difficult to remove thereafter. Thus, packaging food in ovenable flexible bags may present benefits as compared to traditional packaging and cooking apparatuses and methods. Further, although flexible bags have been used in combination with additional packaging in the past, the packaging has generally been limited to use during shipment.

Thus, improvements to flexible containers for food products and related packages have herein been recognized and provided, as will be described below.

BRIEF SUMMARY OF THE INVENTION

Embodiments of the invention provide an assembly for containing a food product that gives off liquid byproducts during heating. The assembly includes a flexible container comprising a first portion and a second portion in fluid communication with the first portion, and a package. A partial seal may separate the first portion and the second portion of the flexible container. The package comprises a base member, a support member coupled to the base member, wherein the support member defines a surface configured to support the first portion of the flexible container and the food product received therein above the base member when the assembly is in a heating position, and a recess positioned below the support member when the assembly is in the heating position to receive the second portion of the flexible container. In such embodiments the second portion of the flexible container is thereby configured to receive the liquid byproducts given off by the food product in the first portion of the flexible container in the recess.

The assembly may further comprise an absorbent material in the second portion of the flexible container or directly in the recess, and the absorbent material may comprise a cellulose material. In some embodiments the package may comprise a low thermal conductivity material, such as a paperboard material. Further, the package may in some embodiments be integral such that the package comprises a single piece of the paperboard material. The assembly may further comprise a cut-resistant coating on the support member.

In some embodiments the assembly is configurable to a storage position, wherein the support member at least partially defines a top portion of the package, and wherein the flexible container is retained between the top portion and the base member. In such embodiments the support member may at least partially define a handle when the assembly is in the storage position. In additional embodiments the assembly further comprises a second support member coupled to the base member. In such embodiments the assembly may be configurable to a storage position, wherein the support member and the second support member at least partially define a top portion of the assembly, and wherein the flexible container is retained between the top portion and the base member. Further, the support member and the second support member may define a handle when the assembly is in the storage position. In other embodiments the second support member may define a second surface, wherein at least one of the surface and the second surface slopes toward the recess when the assembly is in the heating position. In such embodiments the recess may be defined between the support member and the second support member. In other embodiments the assembly may further comprise a removable top portion, wherein the flexible container is retained between the removable top portion and the base member when the assembly is in a storage position.

An additional embodiment of the invention provides a package for containing a food product that gives off liquid byproducts during heating. The package comprises a base member and a support member coupled to the base member, wherein the support member defines a surface configured to support the food product above the base member when the package is in a heating position, and wherein the support member at least partially defines a top portion of the package when the package is in a storage position. When in the storage position the support member may at least partially define a handle. The package further comprises a recess positioned below the support member when the package is in the heating position to receive the liquid byproducts given off by the food product in the recess.

In another embodiment of the invention, a method of packaging a food product that gives off liquid byproducts during heating is provided. The method comprises providing a flexible container comprising a first portion and a second portion in fluid communication with the first portion, enclosing the food product in the first portion of the flexible container, and inserting the flexible container into a package. The package may comprise a base member, a support member coupled to the base member wherein the support member defines a surface configured to support the first portion of the flexible container and the food product received therein above the base member when the assembly is in a heating position, and a recess positioned below the support member when the assembly is in the heating position to receive the second portion of the flexible container. In such embodiments the second portion of the flexible container is thereby configured to receive the liquid byproducts given off by the food product in the first portion of the flexible container in the recess. The method further comprises configuring the package to a storage position wherein the flexible container is retained within the package.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
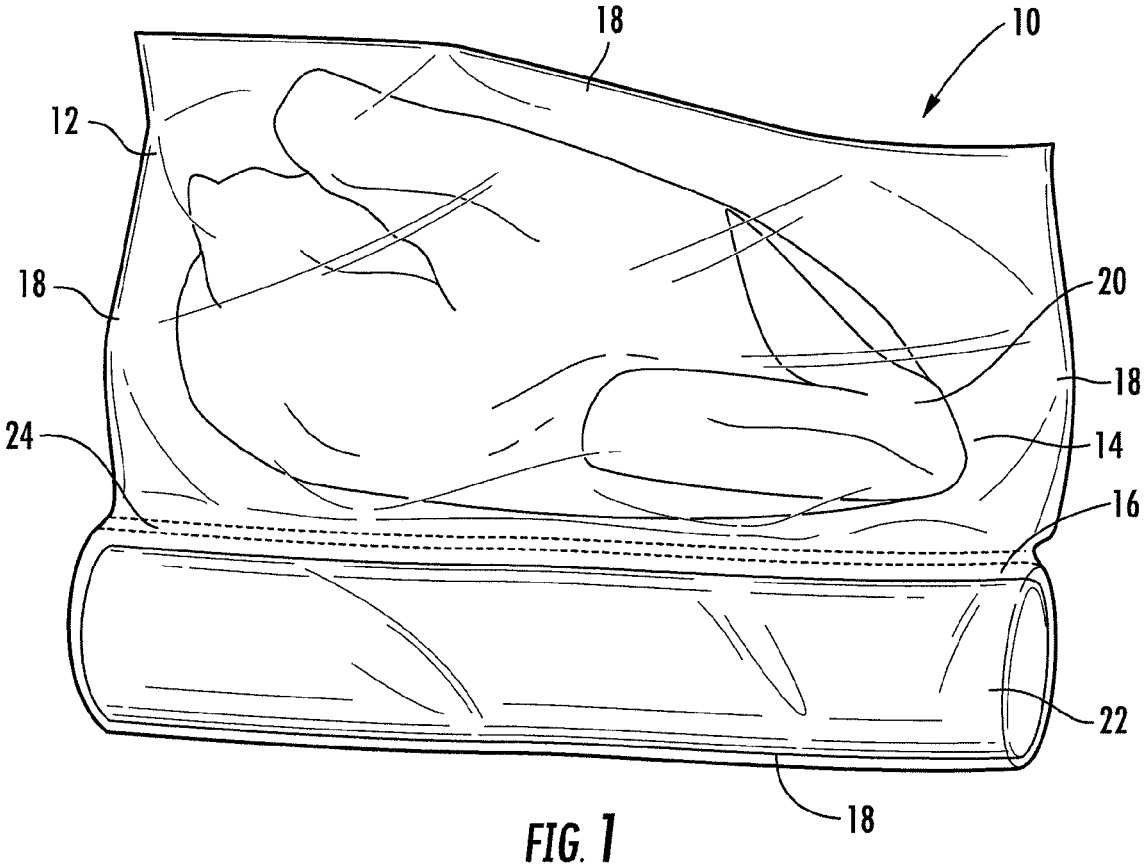
FIG. 1 illustrates a side view of a flexible container with a food product therein according to one embodiment of the invention.

With reference to FIG. 1, a flexible container according to one embodiment of the invention is illustrated and broadly designated by reference number 10. The flexible container 10 may comprise a flexible film 12 which defines a first portion 14 and a second portion 16. The flexible container 10 may be sealed or otherwise configured to form an enclosure such that the first portion 14 and the second portion 16 are substantially separated from the external environment. Thus, the flexible container 10 may comprise multiple pieces of flexible film 12 which are sealed together, or it may comprise a single piece of flexible film which is folded or otherwise configured to form an enclosure. For example, peripheral edges 18 of the flexible film 12 may comprise folds or continuous seals, welds, etc. which seal the first portion 14 and the second portion 16 from the external environment. The peripheral edges 18 of the flexible container 10 may be sealed by bonding opposing surfaces of the flexible film 12 to each other with an adhesive, thermal, ultrasonic fusion, or other suitable bonding method. In one embodiment, the flexible container 10 may comprise a hermetic seal that maintains the first portion 14 and the second portion 16 in a substantially closed state so that fluids cannot ingress into, or egress out of the flexible container.

The flexible container 10 may be used for packaging an item such as a food product 20. In particular, the food product 20 may be retained in the first portion 14 of the flexible container 10. The flexible container 10 may also include an absorbent material 22 therein. The absorbent material 22 may be positioned within the second portion 16 of the flexible container 10. As will be described below, the absorbent material 22 may be configured to absorb or otherwise retain liquid byproducts given off by the food product 20. Liquid byproducts, as used herein, refer to any and all liquid and semi-liquid substances which are emitted from, drained off of, or otherwise produced by the food product 20. For example, liquid byproducts may include grease, blood and water products.

In some embodiments, in order to maintain the position of the absorbent material 22 relative to the food product 20, a partial seal 24 may separate the first portion 14 and the second portion 16 of the flexible container 10. The partial seal 24 may comprise any form of discontinuous seal, weld, etc., so long as the first portion 14 and the second portion 16 of the flexible container 10 remain in fluid communication. Fluid communication allows the absorbent material 22 to receive the liquid byproducts. In other embodiments the first portion 14 and the second portion 16 may refer to portions of a single chamber with no seal in-between. In some embodiments the second portion 16 may define a width (left to right as illustrated in FIG. 1), which is less than the width (left to right as illustrated in FIG. 1) of the first portion 14 of the flexible container. In such embodiments, less flexible film 12 may be required to form the flexible container 10. However, in other embodiments the width of the first portion 14 of the flexible container 10 may be greater than or equal to the width of the second portion 16 of the flexible container.

Removal of the food product 20 from the flexible container 10 may be facilitated by additional features. For example, the flexible container 10 may include a tear notch, line of weakening, or combination thereof, or other means that may help facilitate opening of the flexible container. The notch may comprise a slit or cut that is formed into a side of the flexible film 12 such that pulling along a peripheral edge 18 of the flexible container 10 past the tear notch causes the peripheral edge of the flexible film to be separated and detached from the remaining portion of the flexible container. As a result, the flexible container 10 may be opened so that its contents, such as the food product 20, may be removed.

The term "line of weakening" includes any structure or configuration adapted to facilitate the selective removal of one portion on one side of the line of weakening from another portion on the opposite side of the line of weakening. In some embodiments, a line of weakening may extend laterally across a top portion of the flexible film 12. The line of weakening defines a portion of the flexible container 10 that may be removable. The line of weakening may be provided by a plurality of openings or perforations that extend across the surface of the flexible film 12. The perforations may be spaced sufficiently close to one another along the line so that the removable portion can be easily separated from the flexible container 10. In some embodiments, the flexible container 10 may also include a zipper or other resealable closure device that may permit the flexible container 10 to be opened and re-closed.

The flexible container 10 may be used not only to package a food product 20, but also to cook or otherwise heat the food product therein such as in a microwave or conventional oven. Thus, the flexible container 10 may be used to store and cook or otherwise heat food products 20 which may include meat products, vegetables, corn on the cob, prepared meals, and the like. For example, in the illustrated embodiment the food product 20 comprises a chicken. Accordingly, the absorbent material 22 and the flexible film 12 comprising the flexible container 10 may be selected to withstand elevated temperatures. Thus, in one embodiment the absorbent material 22 may comprise a cellulose material configured to withstand elevated temperatures. Further, the flexible film 12 may comprise a sheet of film or laminate having a melt temperature of at least 200 degrees Fahrenheit ("F"). For microwave oven applications, the flexible film 12 may have a melt temperature in excess of 300 degrees F. Suitable materials may include polyethylenes, polypropylenes, polyesters and copolymers thereof. For conventional oven applications, the flexible film 12 may have a melt temperature in excess of 400 degrees F. and for some applications in excess of 450 degrees F. Suitable materials may include nylons and polyesters, such as polyethylene terephthalate.

The flexible film 12 may have any total thickness as long as it provides the desired properties (e.g., OTR, flexibility, stiffness, optics, strength) for the given packaging application of expected use. In some embodiments the flexible film 12 may have a thickness of less than about any of the following: 10 mils, 5 mils, 4 mils, 3 mils, 2 mils, 1.5 mils, 1.4 mils, 1.3 mils, 1.2 mils, 1.1 mils, and 1 mil. (A "mil" is equal to 0.001 inch.). The flexible film 12 may comprise one or more layers of sealant and/or print films that form a laminate. In other embodiments, the flexible film may include an outer print layer that may be printable or include a trap printed image. The flexible film may include one or more thermoplastic polymers including polyolefins, polystyrenes, polyurethanes, polyvinyl chlorides, nylons, polyesters such as poly(ethylene terephthalate), and ionomers provided that the desired flexibility and melting temperature of the film may be maintained.

Useful polyolefins may include ethylene homo- and copolymers and propylene homo- and co-polymers. Ethylene homopolymers include high density polyethylene ("HDPE") and low density polyethylene ("LDPE"). Ethylene copolymers include ethylene/alpha-olefin copolymers ("EAOs"), ethylene/unsaturated ester copolymers, and ethylene/(meth) acrylic acid. ("Copolymer" as used in this application means a polymer derived from two or more types of monomers, and includes terpolymers, etc.).

In some embodiments, the flexible film 12 may also include one or more additives useful in packaging films, such as, antiblocking agents, slip agents, antifog agents, colorants, pigments, dyes, flavorants, antimicrobial agents, meat preservatives, antioxidants, fillers, radiation stabilizers, and antistatic agents. Such additives, and their effective amounts, are known in the art. An antifog agent may advantageously be incorporated into or coated onto the flexible film. Suitable antifog agents may fall into classes such as esters of aliphatic alcohols, esters of polyglycol, polyethers, polyhydric alcohols, esters of polyhydric aliphatic alcohols, polyethoxylated aromatic alcohols, nonionic ethoxylates, and hydrophilic fatty acid esters. Useful antifog agents include polyoxyethylene, sorbitan monostearate, polyoxyethylene sorbitan monolaurate, polyoxyethylene monopalmitate, polyoxyethylene sorbitan tristearate, polyoxyethylene sorbitan trioleate, poly (oxypropylene), polyethoxylated fatty alcohols, polyoxyethylated 4-nonylphenol, polyhydric alcohol, propylene diol, propylene triol, and ethylene diol, monoglyceride esters of vegetable oil or animal fat, mono- and/or diglycerides such as glycerol mono- and dioleate, glyceryl stearate, monophenyl polyethoxylate, and sorbitan monolaurate. The antifog agent is incorporated in an amount effective to enhance the antifog performance of the flexible film 12.

In some embodiments, the flexible container 10 may comprise a modified atmosphere packaging (MAP). In MAP the surrounding atmosphere in the flexible container 10 is evacuated and replaced with an atmosphere having attributes that may prolong the shelf-life or appearance of the food product 20. In some applications it may be desirable to enclose the food product 20 in a high oxygen atmosphere. For example, when the food product 20 comprises red meat, the atmosphere in the flexible container 10 may comprise about 80% by volume oxygen and about 20% by volume carbon dioxide in order to inhibit the growth of harmful microorganisms and extend the time period in which the meat retains its attractive red ("bloom") coloration. Oxygen and carbon dioxide barrier attributes may also be imparted to the flexible film 12 by incorporating, for example as a film layer, one or more resins having low permeability to oxygen. Such films are generally referred to as "barrier films" and may be designed to prevent oxygen from entering or escaping from the interior of the flexible container 10. The barrier film helps to maintain a high oxygen atmosphere within the flexible container 10 during any subsequent storage, shipment, or display at the point of sale. In other applications, it may be desirable to package the food product 20 in a low oxygen atmosphere.

In some embodiments, the flexible container 10 may also include a cooking temperature indicator such as a strip of temperature-sensitive material which changes color upon reaching a certain temperature. The cooking temperature indicator may be placed on a label so as to give an indication of when the food product 20 is properly heated or within the flexible container 10 so that it is visible through the flexible film 12.

Additionally, in some embodiments the second portion 16 of the flexible container 10 may be printed or opaque. In such embodiments the contents of the second portion 16 of the flexible container may be substantially hidden from view. This may be desirable in some instances to mask the accumulation of unsightly liquid byproducts that have pooled or been absorbed by the absorbent material 22 in the second portion 16 of the flexible container. In other embodiments it may be preferable to form the second portion 16 of the flexible container 10 from flexible film 12 which is at least partially transparent or translucent such that the liquid byproducts may be visible. This embodiment may be preferable in some instances to illustrate the ability of the flexible container 10 to separate the liquid byproducts from the food product 20, which may be desirable to certain users for health or other reasons.

Figure 2:
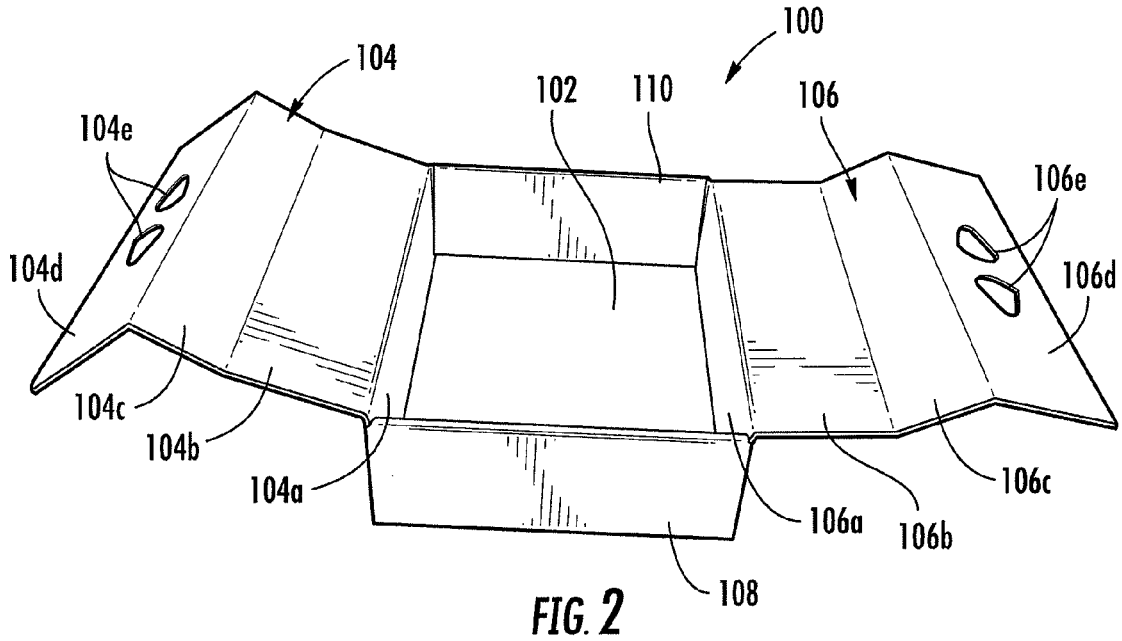
FIG. 2 illustrates a perspective view of a first embodiment of a package according to the invention, wherein the package is in an intermediate position.

Referring now to FIG. 2, one embodiment of a package 100 for containing a food product is illustrated. In some embodiments the package 100 may be configurable between multiple positions. In particular, the package 100 may be configurable between a storage position (see FIG. 9) and a heating position (see FIG. 4), with FIG. 2 illustrating an intermediate position therebetween. The intermediate position illustrated in FIG. 2 may represent a position whereby a food product is inserted into the package 100 prior to configuring the package to the storage position. Alternatively, the intermediate position may represent a position whereby the food product is initially removed from the package 100 prior to configuring the package to the heating position for cooking or otherwise heating the food product.

As illustrated in FIG. 2, the package 100 comprises a base member 102 which may form a bottom surface of the package. The package 100 also comprises a support member 104 and in some embodiments a second support member 106, which may comprise flaps, and which are coupled to the base member 102 and may thereby extend from opposing sides of the package 100. The support members 104, 106 may each include a plurality of segments 104*a-d*, 106*a-d* which may be separated by folds or other articulation facilitating features in the respective support member. First segments 104*a*, 106*a* of the support members 104, 106 may be configured such that they extend substantially perpendicularly to the base member 102. First 108 and second 110 end members may also be coupled to the base member 102, and they may also extend substantially perpendicularly therefrom. Accordingly, the base member 102, support members 104, 106, and first 108 and second 110 end members may in combination define a container configured to receive a food product therein.

The package 100 may in some embodiments comprise an integral single piece of material which is folded or otherwise manipulated to form the package. In other embodiments multiple pieces of material may be glued or otherwise coupled to form the package 100. The material forming the package 100 may in some embodiments be configured to withstand cooking or other forms of heating such as in a microwave or conventional oven. Suitable materials for conventional oven applications may have a melting or burning temperature in excess of at least 350 degrees F.

The material forming the package 100 may comprise a low thermal conductivity material. A low thermal conductivity material may facilitate handling of the package 100 after it has been heated due to the material being a relatively poor conductor of heat. As used herein, low thermal conductivity refers to materials which have a thermal conductivity of less than 1 watt/meter-Kelvin at 25 degrees Celsius.

In some embodiments the material forming the package 100 may comprise a paperboard material or other paper-based product, which may comprise a low thermal conductivity material. In some embodiments paperboard materials may include a vegetable-fiber web formed from a water suspension. The paperboard material may be generally thicker than paper. For example, paperboard materials may be over 0.25 mm or 10 points in thickness, though in other embodiments the thickness may be greater or less. In terms of density, the paperboard material may comprise a basis weight above 224 $g/m^2$, but in other embodiments the paperboard material may be more or less dense. The paperboard material may also be single or multiply. Further, the paperboard material may in some embodiments be referred to as boxboard. As used herein, paperboard material may in some embodiments comprise a corrugated fiberboard. Corrugated fiberboard may be a paper-based material comprising a fluted corrugated sheet and one or two flat linerboards.

In some embodiments the paperboard material may be ovenable, such as when the package 100 is configured for use in a conventional oven. Additionally, some embodiments of the package 100 may use a grease and/or moisture resistant paperboard material, such as a coated paperboard material. For example, a coated paperboard material may be used in embodiments in which the food product 20 is supported directly by the package 100.

In one embodiment the paperboard material may comprise PRINTKOTE® as manufactured by MeadWestvaco of Atlanta, Ga. In such embodiments the paperboard material may comprise solid bleached sulfate (SBS) paperboard, which may be clay-coated on one side and polyester-coated on one side. The paperboard material may be configured to withstand temperatures of 400 degrees F. to −40 degrees F. such that it may be both ovenable and freezable. The paperboard material may be a bleached, coated paperboard which may be moisture and heat-resistant and heat-sealable. The coat of polyester barrier polymers may help the paperboard material withstand cold or hot temperatures and moisture. The coat of clay may provide the paperboard material with a smooth surface configured for printing of graphics. In some embodiments the paperboard material may be recyclable.

Figure 3:
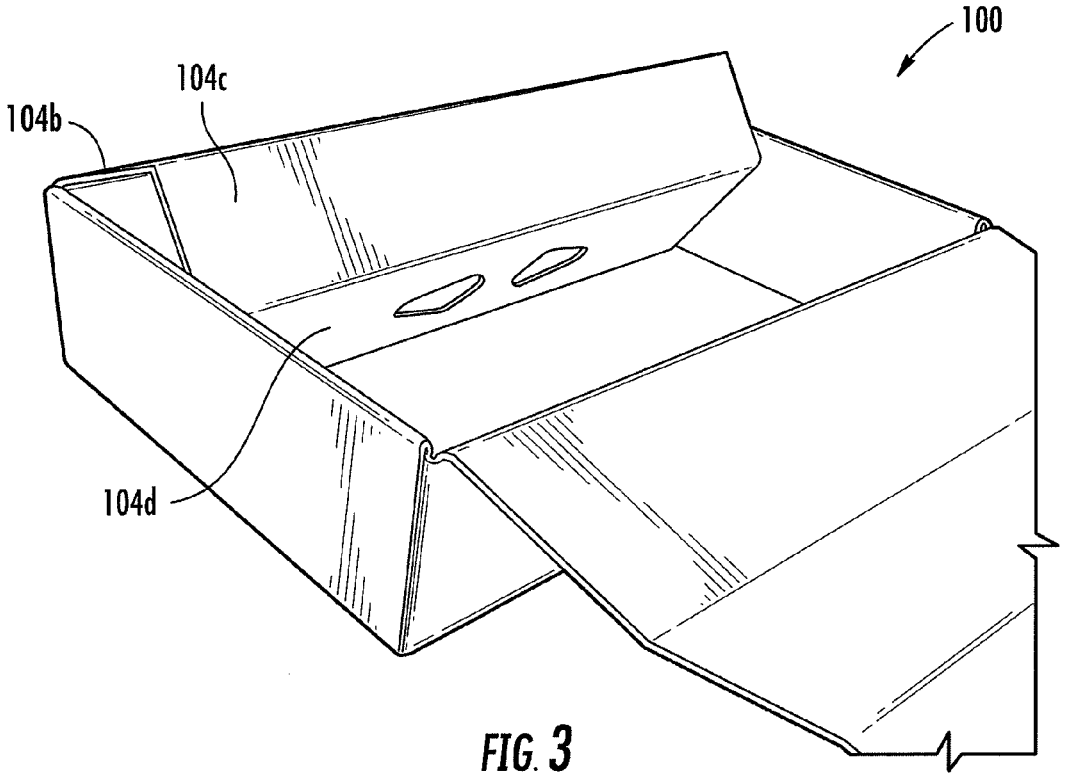
FIG. 3 illustrates a perspective view of the package of FIG. 2, wherein a support member is being folded inwardly.
Figure 4:
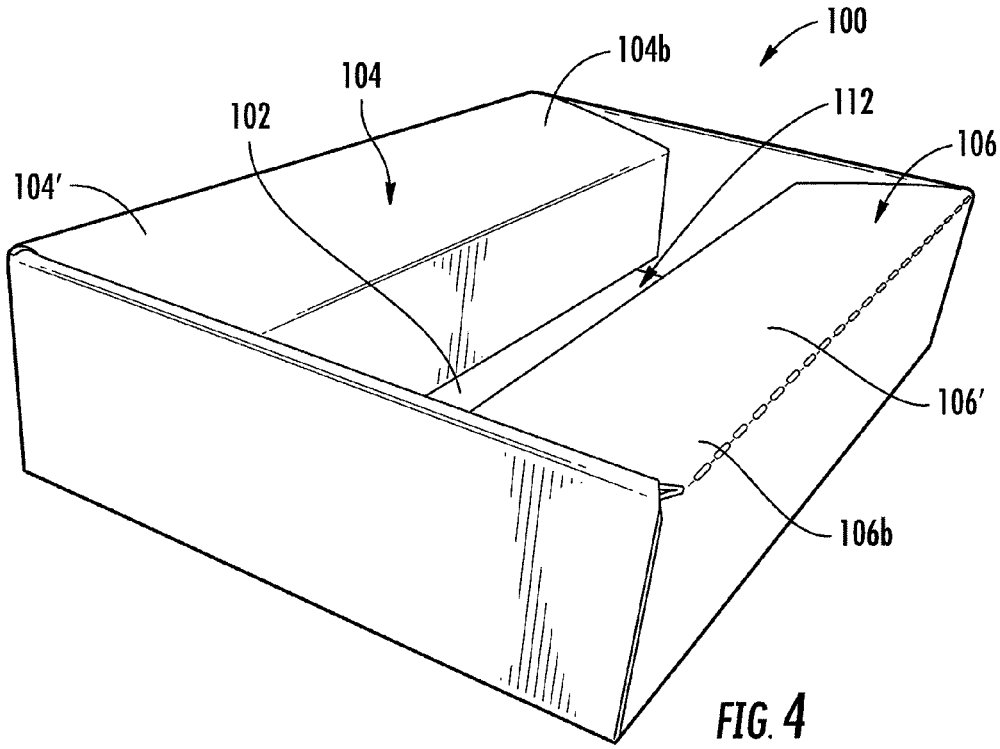
FIG. 4 illustrates a perspective view of the package of FIG. 2, wherein the package is in a heating position.

Returning to the configurability of the package 100, FIG. 3 illustrates the package 100 as it is transformed from the intermediate position as illustrated in FIG. 2 to the heating position illustrated in FIG. 4. Note that although this description provides details with respect to one embodiment of a package 100, not all embodiments of the invention will function exactly as described. As illustrated, the support member 104 is folded or otherwise manipulated inwardly toward the base member 102. In particular, the second 104*b*, third, 104*c*, and fourth 104*d* segments of the support member are generally folded inwardly while the first segment 104*a* remains generally perpendicular to the base member 102. Thus, the fourth segment 104*d* is directed to a position generally parallel with the base member 102, and the third segment 104*c* is directed to a position generally perpendicular with the base member. Depending on the respective lengths of the first segment 104*a* and the third segment 104*c*, the second segment 104*b* may or may not form an angle with the base member 102. When there is a second support member 106, as illustrated, the segments 106*a-d* may fold inwardly in substantially the same manner.

Accordingly, as illustrated in FIG. 4, the package 100 may be configurable to a heating position. When in the heating position, the package 100 comprises a recess 112 positioned at a height generally below the support member 104. When the package 100 additionally comprises a second support member 106, the recess 112 may be defined not only below the support member 104 and the second support member, but also between the support member and the second support member. As further illustrated in FIG. 4, when in the heating position the support member 104 defines a surface 104' configured to support a food product above the base member 102. In particular, the surface 104' may be defined by the second segment 104*b* of the support member 104. When the package 100 comprises a second support member 106, as illustrated, the second support member defines a second surface 106', which may be defined by the second segment 106*b*.

Additionally, as a result of the heating position locating the recess 112 below the support surface(s) 104, 106, the recess is thereby configured to receive liquid byproducts given off by a food product. In some embodiments the package 100 may further comprise an absorbent material positioned within the recess 112. The absorbent material may be positioned directly within the recess 112, such as by attaching the absorbent material to the base member 102. In some embodiments the absorbent material may comprise a cellulose material.

Further, as mentioned above, the second segment 104*b* may form an angle with the base member 102 in some embodiments, depending on the length of the first 104*a* and third 104*c* segments of the support member 104. Accordingly, in some embodiments the surface 104' will slope toward the recess 112 when the package 100 is in the heating position, as illustrated in FIG. 4. Additionally or alternatively, the second surface 106' may slope toward the recess 112 when the package is in the heating position. Similarly as with the surface 104', the second surface 106' may slope toward the recess when the first segment 106*a* of the second support member 106 is longer than the third segment 106*c*.

In some embodiments the package 100 may be used to support a food product not only during heating of the food product, but also during cutting of the food product thereafter.

Accordingly, one or both of the support member 104 and the second support member 106 may comprise a cut-resistant material or coating. In particular, a cut-resistant coating may be applied to one or both of the surface 104' and the second surface 106'. Accordingly a user may cut the food product while it is still supported on the support members 104, 106, which may further simply cleanup by not requiring transfer of the food product to a separate dish for cutting.

Figure 5:
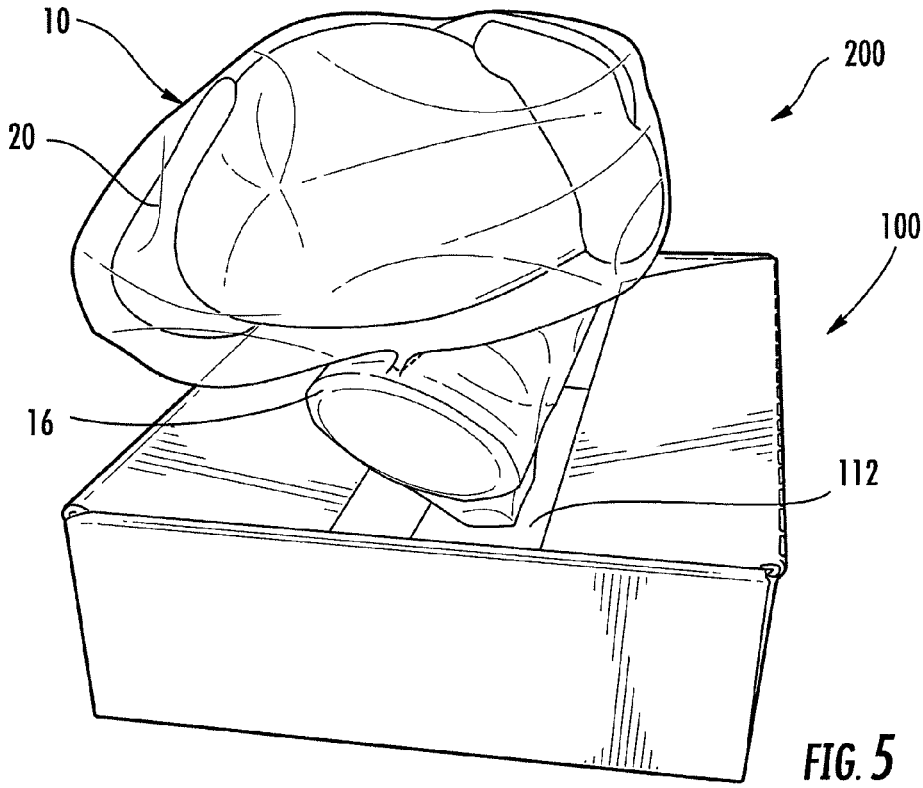
FIG. 5 illustrates a perspective view of the flexible container of FIG. 1 being added to the package of FIG. 2 to form a first embodiment of an assembly.

In some embodiments the food product may be placed directly on the surface 104' and the second surface 106' and heated directly thereon without use of a flexible container. In such embodiments the liquid byproducts given off by the food product may be received directly in the recess 112. However, in other embodiments the package may comprise a portion of an assembly for containing a food product that gives off liquid byproducts during heating. The assembly may additionally comprise a flexible container. For example, FIG. 5 illustrates an assembly 200 comprising the package 100 in combination with the flexible container 10. In particular, FIG. 5 illustrates the placement of the flexible container 10 including the food product 20 into the heating position with the package 100. As illustrated, when the flexible container 10 is inserted into the package 100, the second portion 16 of the flexible container is directed toward the recess 112.

Figure 6:
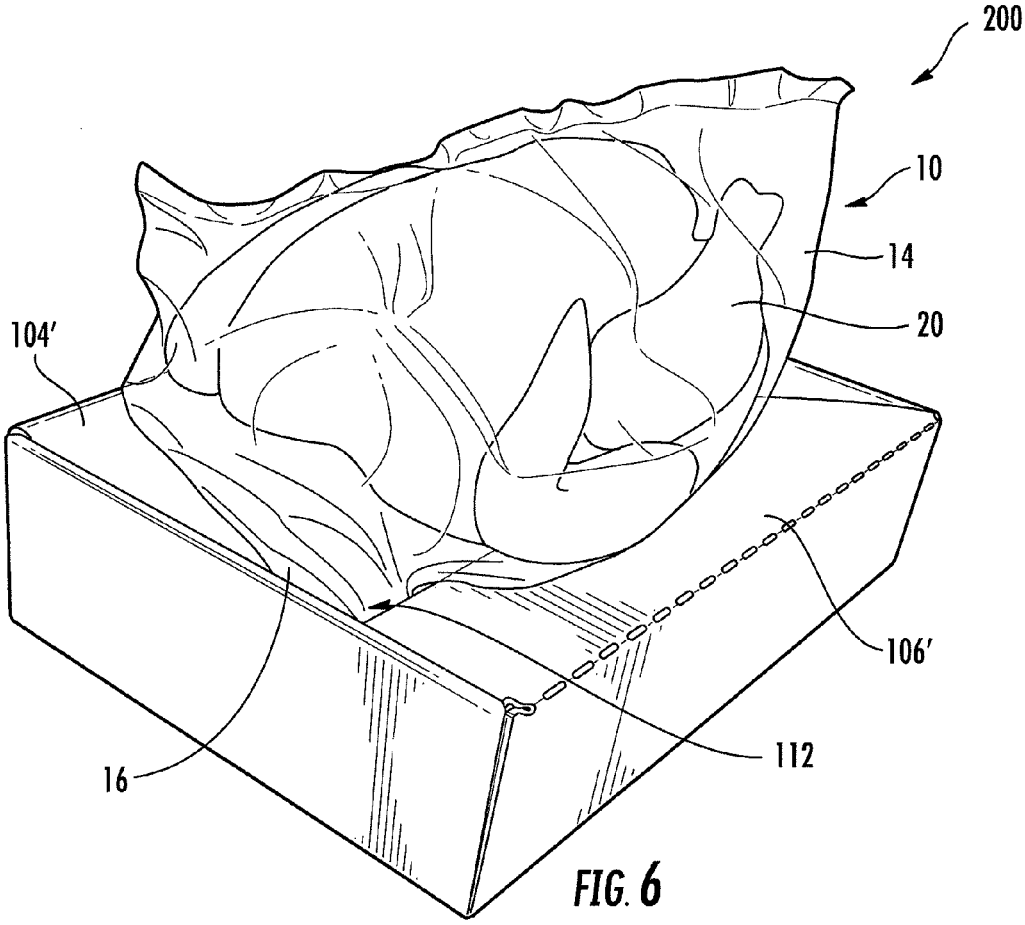
FIG. 6 illustrates a perspective view of the assembly of FIG. 5 in a heating position.
Figure 7:
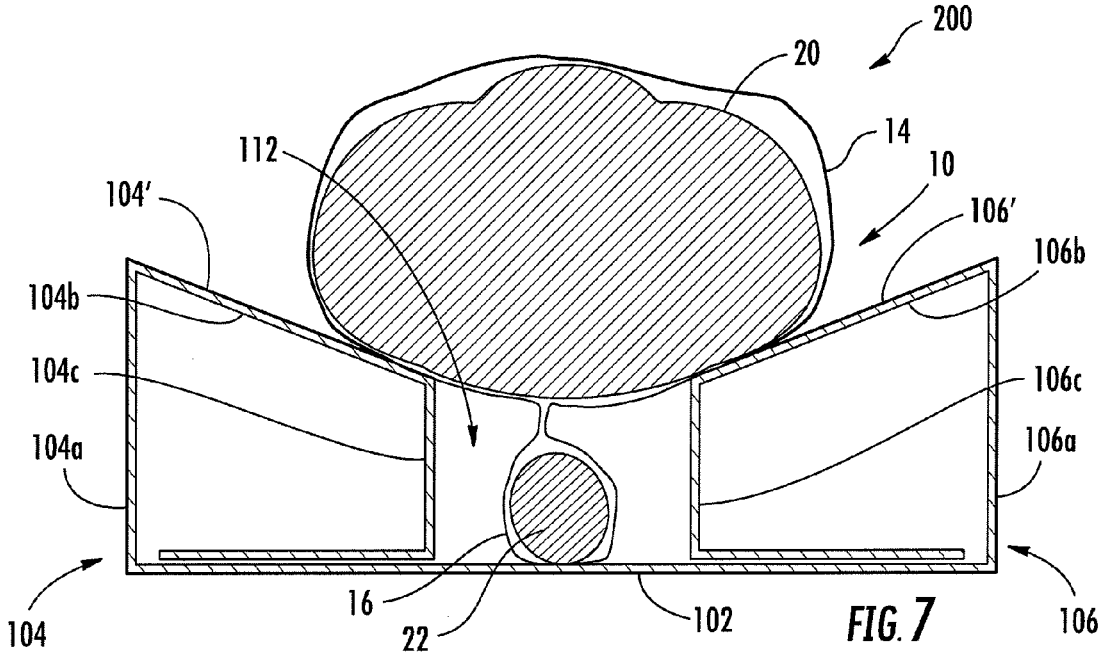
FIG. 7 illustrates a sectional view through the assembly of FIG. 5 in the heating position.

FIG. 6 illustrates the assembly 200 in the heating position, wherein the second portion 16 of the flexible container 10 is received in the recess 112 of the package 100. The first portion 14 of the flexible container 10 and the food product 20 received therein are supported by the surface 104' and, in some embodiments such as the illustrated embodiment, the second support surface 106'. FIG. 7 illustrates a cross-sectional view through the assembly 200 when the assembly is in the heating position. In this embodiment, the first segments 104*a*, 106*a* of the support members are longer than the third segments 104*c*, 106*c* of the support members, and as previously described, the surface 104' and the second surface 106' (as defined by the second segments 104*b*, 106*b*) slope toward the recess 112. However in other embodiments the surface 104' and/or the second surface 106' may, for example, be positioned such that they are generally parallel with the base member 102.

As illustrated, the first portion 14 of the flexible container 10 and the food product 20 received therein are supported by the surface 104' and the second surface 106', though in embodiments without the second support member 106, the first portion and food product may be supported only by the surface on the support member 104. Further, the recess 112 receives the second portion 16 of the flexible container 10, which may contain the absorbent material 22 therein. Accordingly, as a result of the first portion 14 of the flexible container 10 being in fluid communication with the second portion 16 of the flexible container, the second portion is thereby configured to receive the liquid byproducts given off by the food product 20 in the first portion of the flexible container in the recess 112. Thus, for example, when the food product 20 is heated or otherwise cooked, liquid byproducts may be received in the recess 112 below the support member 104 and the second support member 106 in the second portion 16 of the flexible container 10. Alternatively when the food product is cooked directly on the support members of the package without a flexible container, the liquid byproducts may be received directly in the recess. As described above, such embodiments of the invention may include an absorbent material directly in the recess.

In some embodiments receipt of the liquid byproducts in the recess 112 may be facilitated by the surface 104' and/or the second surface 106' defining a slope toward the recess when in the heating position, which may direct the liquid byproducts toward the second portion 16 of the flexible container 10. Therefore, the liquid byproduct may be received and stored in the second portion 16 of the flexible container 10 away from the food product 20 or directly in the recess. This may reduce the accumulation of liquid byproducts on and around the food product 20, which may appeal to some consumers. For example, grease and other liquid byproducts may drain out of and off of the food product 20 into the second portion 16 of the flexible container 10 in the recess 112 such that the food product may be less messy at the end of the cooking process. When the food product is cooked directly on the surface of the support member, without using a flexible container, the package may be sealed at the intersections of the end members with the support members, or the package may include an insert on top of the base member in order to resist leakage of the liquid byproducts. Additionally, in some embodiments the package may be coated to prevent leakage of the byproducts through the material comprising the package.

Figure 8:
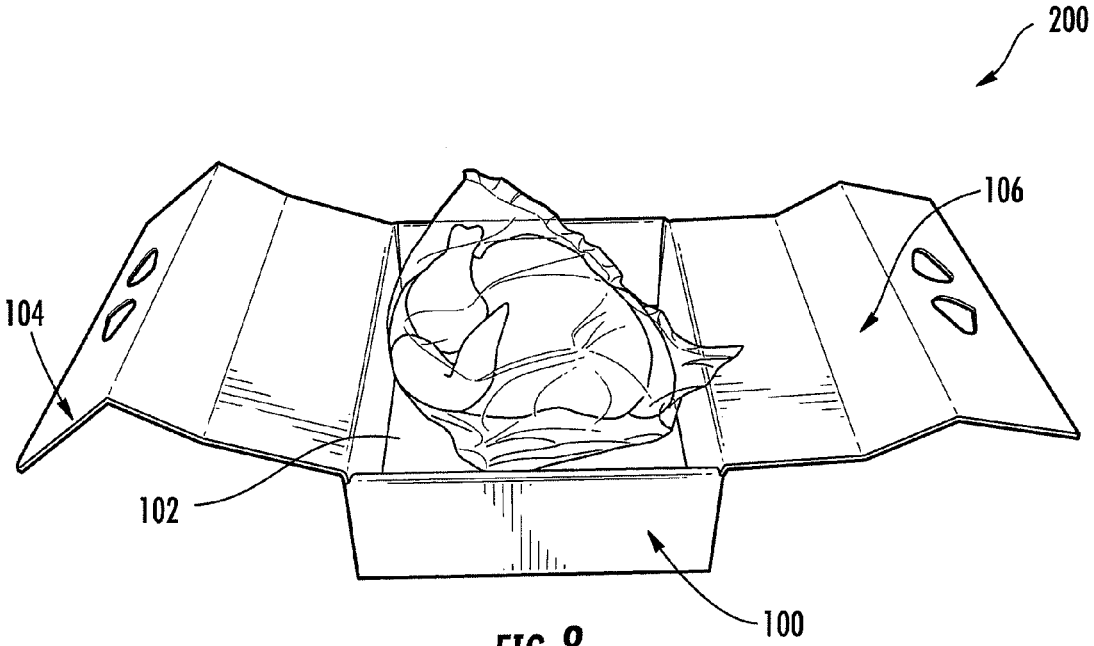
FIG. 8 illustrates a perspective view of the assembly of FIG. 5 in an intermediate position.

Further, some embodiments of the assembly 200 including the package 100 are configurable to a storage position, as previously mentioned. To initially configure the assembly 200 to the storage position, the support member 104 and the second support member 106 may be configured such that they are positioned generally away from the base member 102, such as illustrated in the configuration of the package 100 shown in FIG. 2. Accordingly, as illustrated in FIG. 8, the food product 20 in the flexible container 10 and/or other items may be placed in the package 100.

Figure 9:
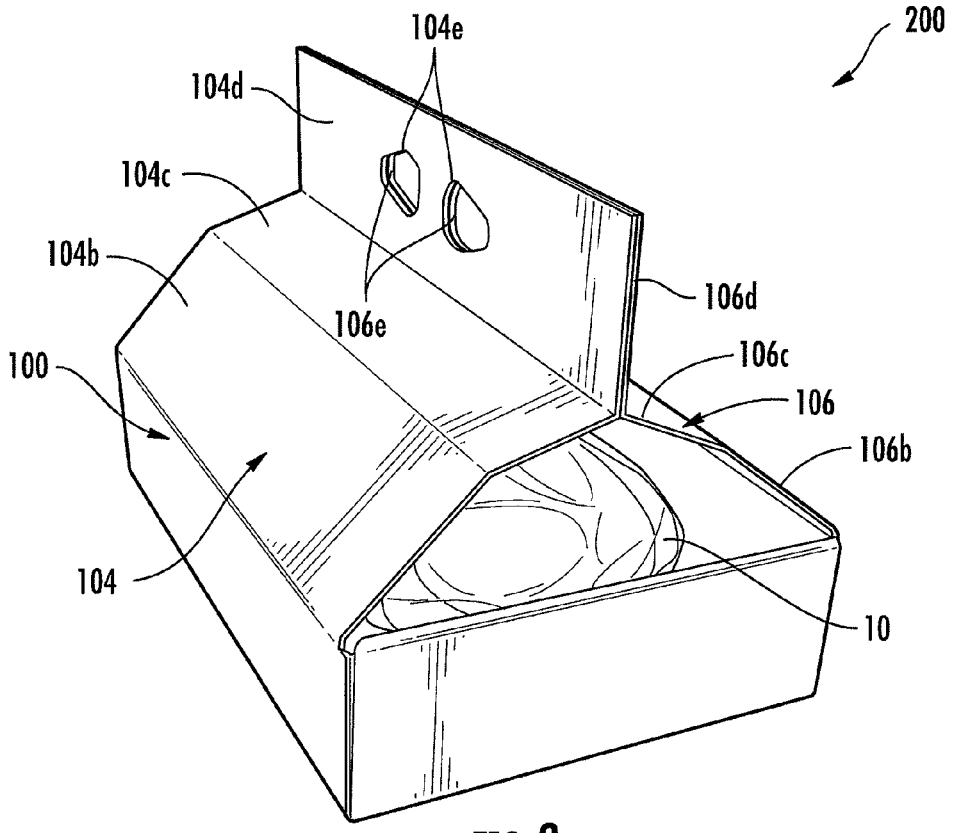
FIG. 9 illustrates a perspective view of the assembly of FIG. 5 in a storage position.

Thereafter, as illustrated in FIG. 9, the support member 104 and the second support member 106 may be generally be folded inwardly and upwardly above the flexible container 10 when the package 100 is part of an assembly 200. In particular, the support member 104 and the second support member may be folded such that they each at least partially define a top portion of the package 100. For example, the fourth segments 104*d*, 106*d* may couple to one another to thereby form a top portion which may generally be described as a gable configuration, as illustrated in FIG. 9. Thus, the flexible container 10 may be retained between the top portion (illustrated as comprising the second through fourth segments 104*b*-*d*, 106*b*-6 of the support members 104, 106) and the base member 102. Although the package 100 is herein illustrated with both the support member 104 and the second support member 106 forming the top portion of the package, in some embodiments the support member 104 may at least partially define a top portion of the package 100 without the second support member 106. Thus in some embodiments the flexible container 10 may be retained between the top portion (comprising the support member 104), and the base member 102. In other embodiments the package may comprise a removable top portion which retains the flexible container between the removable top portion and the base member when the assembly is in a storage position. For example, the package may comprise a line of weakening, such as perforations, which facilitates separation of the removable top portion from the package. This embodiment may be useful in instances wherein the one or more support members are fixed in location, and do not fold out.

In some embodiments the support member 104 and/or the second support member 160 may at least partially define a handle when the assembly 200 is in the storage position. For example, in the embodiment illustrated in FIG. 2 the support member 104 and the second support member 106 each define a pair of holes 104*e*, 106*e*. As illustrated in FIG. 9, when the assembly 200 is configured to the storage position, the pairs of holes 104*e*, 106*e* in the support member 104 and the second support member 106 align to form a handle. Thus, the package 100 may be carried while in the support position using the handle.

Figure 10:
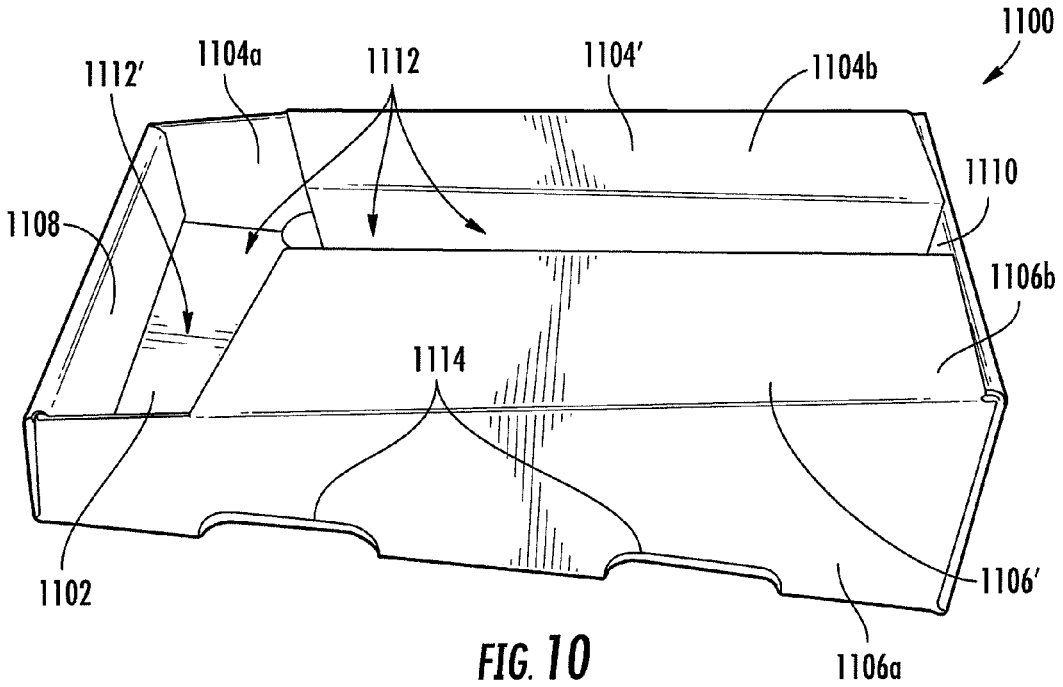
FIG. 10 illustrates a perspective view of a second embodiment of a package according the invention in a heating position.
Figure 11:
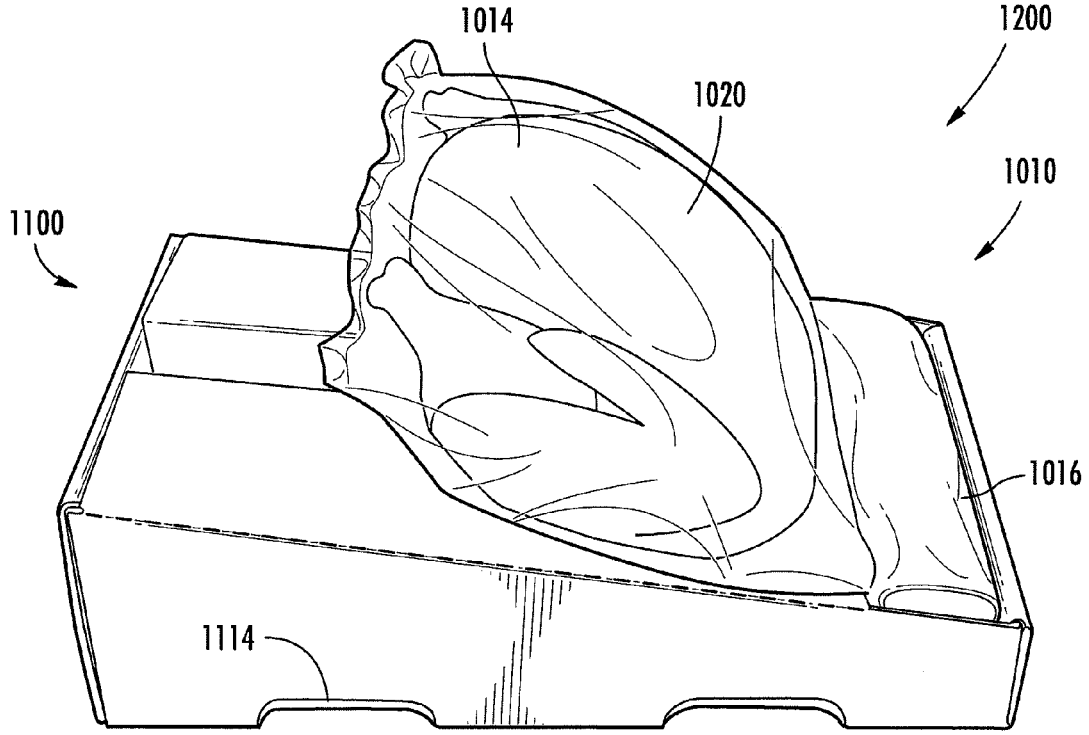
FIG. 11 illustrates a perspective view of an assembly comprising a second embodiment of a flexible container and the package of FIG. 10 in a heating position.

An additional embodiment of a package and assembly for containing a food product that gives off liquid byproducts during heating is illustrated in FIGS. 10 and 11. As illustrated in FIG. 10, the package 1100 comprises many of the features and elements of the previously-described package 100, and accordingly description of the package will generally be limited to differences between the two embodiments of packages. One such difference is that the recess 1112 defines an end section 1112' below the support members 1104 and 1106 which is displaced from the support members in the direction of one of the end members 1108, 1110. In particular, in the illustrated embodiment the second segments 1104*b*, 1106*b* of the support members 1104, 1106 do not extend across the entirety of the base member 1102 from the second end member 1110 to the first end member 1108. Accordingly, in some embodiments the surface 1104' and the second surface 1106' may slope toward the end section 1112' of the recess 1112.

An additional difference is that the package 1100 comprises apertures 1114. The apertures may be added to or removed from any of the embodiments of packages described herein. In the illustrated embodiment, the apertures 1114 extend through portions of the base member 1102 and first segments 1104*a*, 1106*a* of the support members 1104, 1106. The apertures 1114 may thereby allow air to flow under and around the food product 1020 and thereby the apertures may facilitate more even cooking of the food product.

As illustrated in FIG. 11, the flexible container 1010 configured for use with the package 1100 illustrated in FIG. 10 may also include differences with respect to the previously-described flexible container. In particular, the flexible container 1010 comprises a second portion 1016 which is positioned generally beside, instead of underneath, the first portion 1014 of the flexible container 1010, which contains the food product 1020. When the food product 1020 comprises a poultry product such as a chicken or Cornish hen, the food product may be positioned such that the neck portion of the food product is adjacent the second portion 1016 of the flexible container 1010. This configuration may facilitate placement of the food product 1020 into the first portion 1014 of the flexible container 1010. As also illustrated in FIG. 11, when the assembly 1200 is in the heating position, the second portion 1016 of the flexible container 1010 is received in the end section 1112' of the recess 1112. Further, the package 1100 may be configured into a storage position whereby the support members 1104, 1106 form a top portion which may generally be described as a gable configuration. Thus, the storage configuration for the assembly 1200 is substantially similar to the previously described embodiment of an assembly, except there will be an open section which is not covered as a result of the second segments of the support members not extending all the way across the base member. In some embodiments this may be preferable as it may allow a consumer to view the food product prior to purchase.

Figure 12:
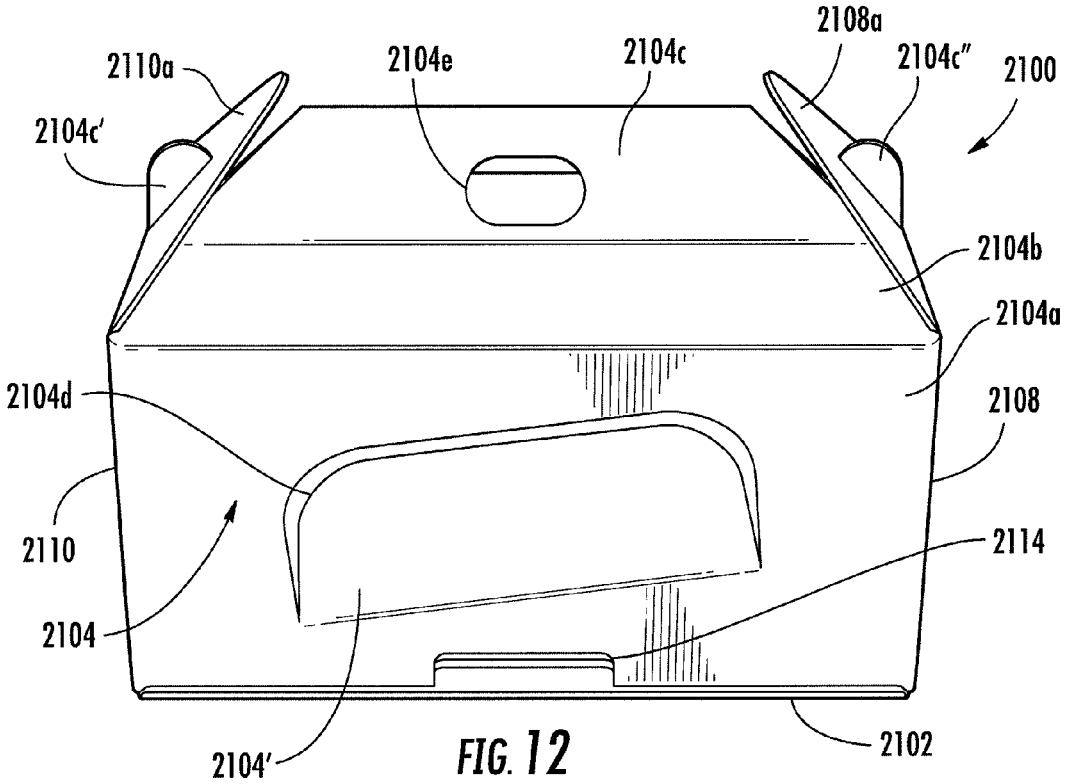
FIG. 12 illustrates a side view of a third embodiment of a package according to the invention in a storage position.
Figure 13:
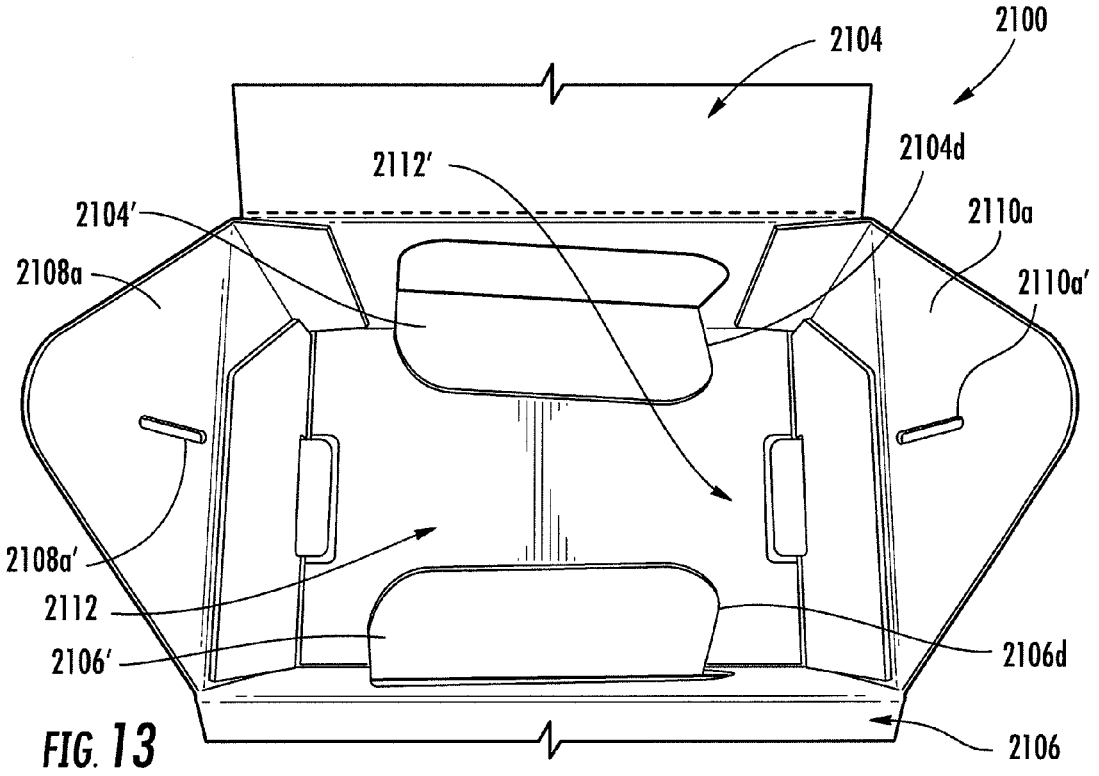
FIG. 13 illustrates a top view of the package of FIG. 12 in an intermediate position.

A further alternative embodiment of a package and assembly for containing a food product that gives off liquid byproducts during heating is illustrated in FIGS. 12-15. FIG. 12 illustrates the package 2100 in a storage position. In this embodiment, the support member 2104 includes three segments 2104*a-c*. The first segment 2104*a* includes a flap 2104*d* which defines a surface 2104' that is configured to support a food product, as will be described later. The package 2100 additionally includes apertures 2114, which may be defined, for example, in the first segment 2104*a* of the support member 2104 and the base member 2102. The second 2104*b* and third segments 2104*c* may extend from the first segment 2104*a* to define a top portion and handle. In particular, the third segment 2104*c* may comprise a hole 2104*e* which may be useable as a handle.

First 2108 and second 2110 end members may also be coupled to the base member 2102, and they may extend substantially perpendicularly therefrom. The end members 2108, 2110 may include upper segments 2108*a*, 2110*a*, which include respective slots 2108*a'*, 2110*a'* (see FIG. 13). When the package 2100 is configured to the storage position, as illustrated in FIG. 12, first 2104*c'* and second 2104*c''* tabs extending from the third segment 2104*c* of the support member 2104 may be directed into and through the slots 2108*a'*, 2110*a'* defined in the upper segments 2108*a*, 2110*a* of the end members 2108, 2110. Accordingly, the package 2100 may remain securely closed while in the storage position. Similarly to the previously described embodiments, the package 2100 may include a second support member 2106 which may in some embodiments include some or all of the features of the support member 2104.

In order to configure the package 2100 to the heating position from the storage position, the package may be initially opened and any food product therein may be temporarily removed. In order to open the package 2100, the upper segments 2108*a*, 2110*a* of the end members 2108, 2110 are folded outwardly such that the first 2104*c'* and second 2104*c''* tabs defined by the third segment 2104*c* of the support members 2104, 2106 come out of the slots 2108*a'*, 2110*a'*. The support members 2104, 2106 are also folded generally outwardly so as to allow access to the inside of the package 2100 and any food product therein. Once any food product therein is removed, the flaps 2104*d*, 2106*d* are folded generally inwardly. As illustrated in FIG. 12, the flaps 2104*d*, 2106*d* may be folded such that they form an angle relative to the base member 2102. Accordingly, the surface 2104' and the second surface 2106' may slope generally toward an end section 2112' of the recess 2112.

Figure 14:
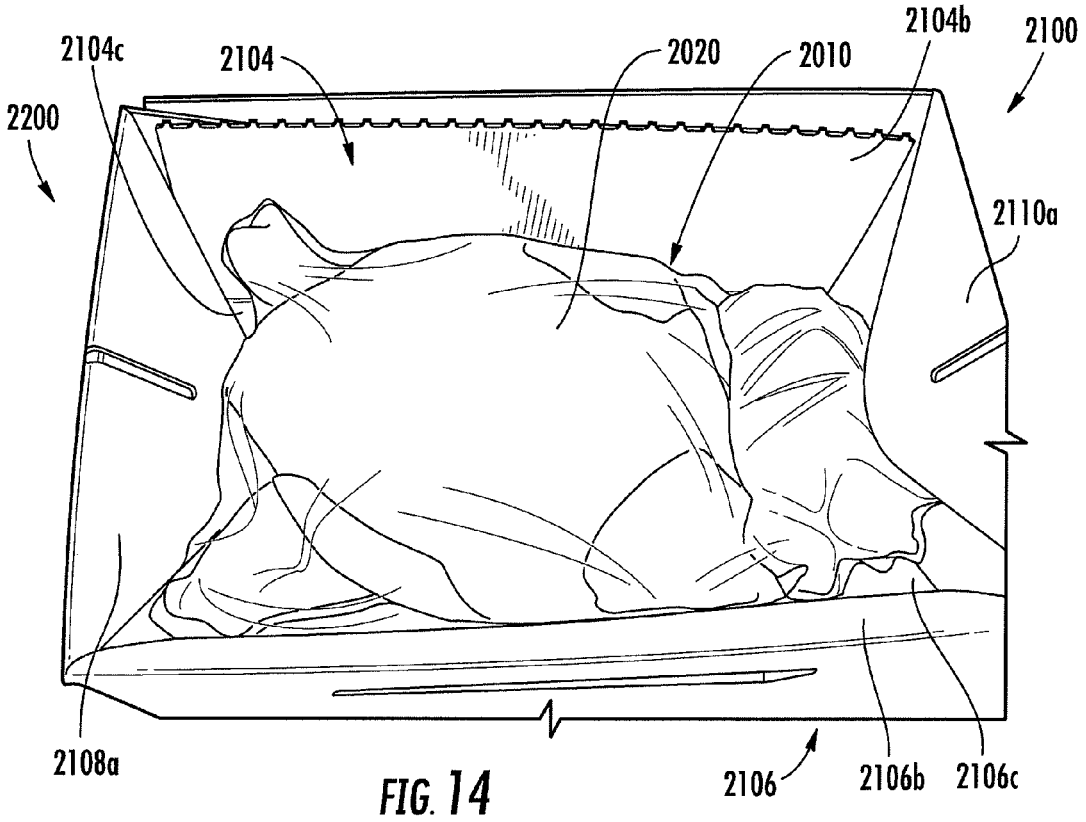
FIG. 14 illustrates a top view of an assembly comprising the second embodiment of the flexible container of FIG. 11 and the package of FIG. 12 in a heating position.

Once the flaps 2104*d*, 2106*d* are folded in, the food product 2020 which may be inside the first portion 2014 of a flexible container 2010, may be inserted into the package 2100 to thereby be supported by the surface 2104' and the second surface 2106' of the support members 2104, 2106. In some embodiments, as illustrated in FIG. 14, the upper segments 2108*a*, 2110*a* may be folded inwardly prior to inserting the food product 2020 into the package 2100. By folding the upper segments 2108*a*, 2110*a* inwardly, the assembly 2200 may comprise a more compact form when in the heating position. Further, in some embodiments the upper segments 2108*a*, 2110*a* may further contact the flexible container 2010 or food product 2020 to thereby center and/or support the food product within the package 2100.

Additionally, in some embodiments one or more of the segments comprising the support members may be removable. For example, the support members 2104, 2106 may be separable between the first 2104*a*, 2106*a* and second 2104*b*, 2104*b* segments. In some embodiments this may be used to cause the heating position of the package 2100 to take a more compact form. In other embodiments, as illustrated in FIG. 14, the second 2104*b*, 2106*b* and third 2104*c*, 2106*c* segments may then be placed on the surface 2104' and second surface 2106' respectively to further support and/or center the food product 2020. Thus, the second 2104*b*, 2106*b* and third 2104*c*, 2106*c* segments of the support members 2104, 2106 may retain the food product 2020 between the removable top portion they define and the base member 2102 while in the storage position and provide support and/or centering for the food product while in the heating position. Alternatively, the support members 2104, 2106 may be folded inwardly to provide support and/or centering for the food product without separating the second 2104*b*, 2106*b* and third 2104*c*, 2106*c* segments from the first segments 2104*a*, 2106*a* of the support members 2104, 2106.

Figure 15:
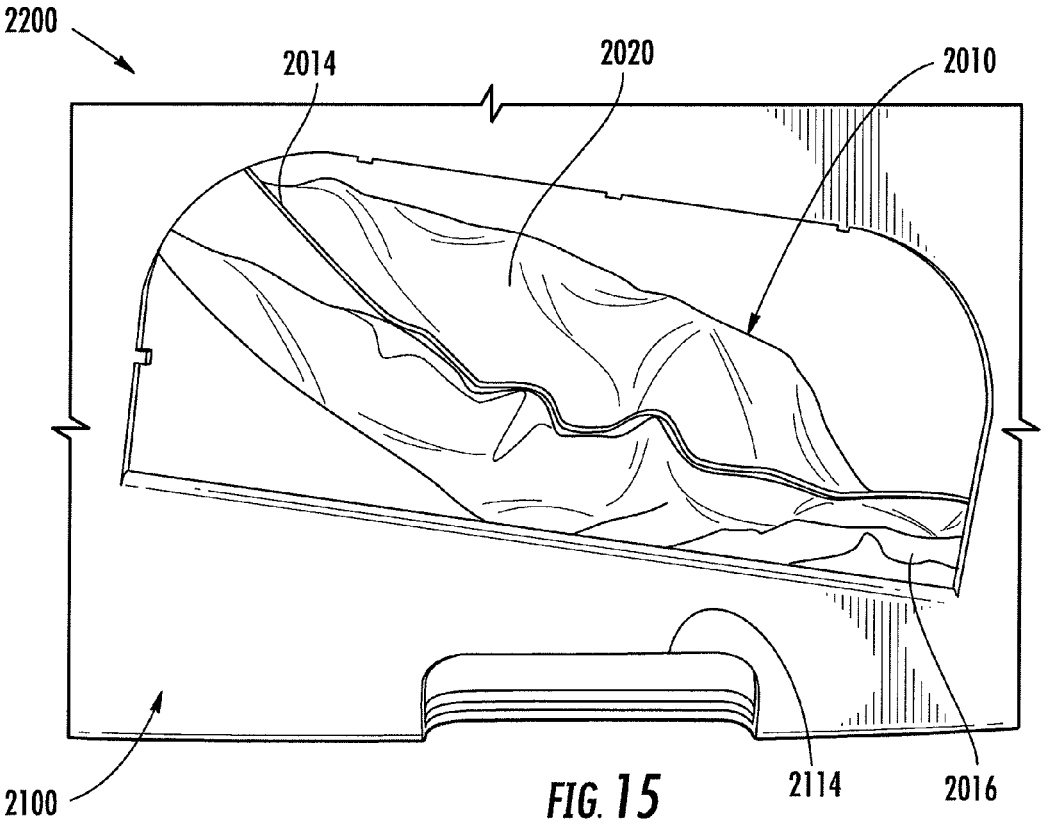
FIG. 15 illustrates a partial side view of the assembly of FIG. 14.

Regardless of whether the upper segments 2108*a*, 2110*a* provide support and/or centering for the food product 2020 and regardless of whether the segments comprising the support members 2104, 2106 are removable, the surface 2104' and the second surface 2106' may slope toward the end section 2112' of the recess, as described above. Accordingly, as illustrated in FIG. 15, during heating the liquid byproducts may be directed out of the first portion 2014 of the flexible container 2010 toward the second portion 2016 of the flexible container. Further, as with the previously described embodiment, the apertures 2114 may allow air to flow under and around the food product 2020 and thereby the apertures may facilitate more even cooking of the food product.

Figure 16:
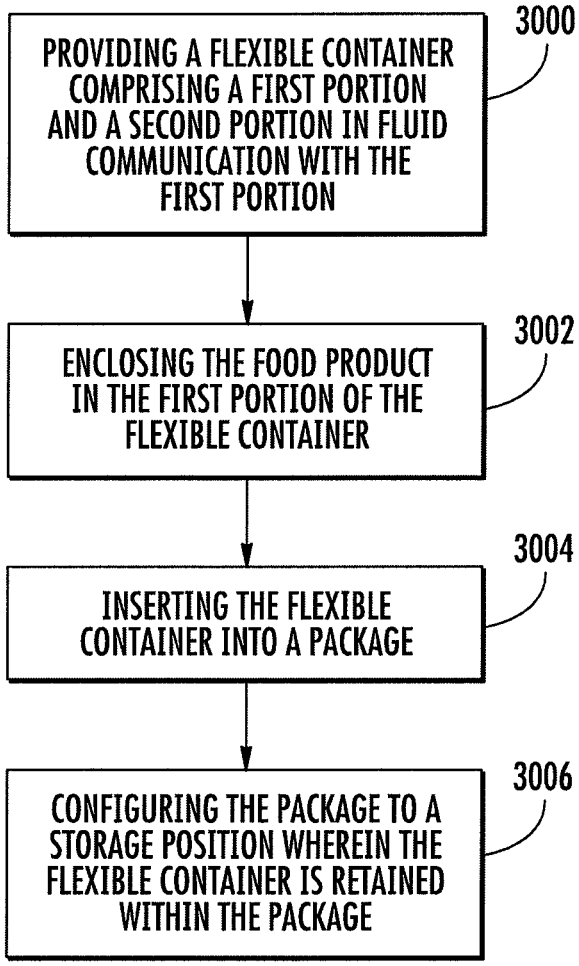
FIG. 16 illustrates a flow chart of a method according to one embodiment of the invention.

A method of packaging a food product that gives off liquid byproducts during heating is also provided. As illustrated in FIG. 16, the method includes providing a flexible container comprising a first portion and a second portion in fluid communication with the first portion at operation 3000. The method further comprises enclosing the food product in the first portion of the flexible container at operation 3002. At operation 3004 the method further includes inserting the flexible container into a package. The package used in this method may be one of the embodiments of packages 100, 1100, 2100 as described herein. Additionally, the method comprises configuring the package to a storage position wherein the flexible container is retained within the package at operation 3006. Accordingly, a food product may be packaged using this method, such that in some embodiments the food product may be ready for retail sale.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An assembly for containing a food product that gives off liquid byproducts during heating, comprising:

a flexible container comprising a first substantially enclosed portion and a second substantially enclosed portion, the second substantially enclosed portion being separated from the first substantially enclosed portion by a connecting portion of the flexible container configured to maintain the second substantially enclosed portion in fluid communication with the first substantially enclosed portion; and a package comprising:

a base member;

a support member coupled to the base member, wherein the support member defines a surface configured to support the first substantially enclosed portion of the flexible container and the food product received therein above the base member when the assembly is in a heating position; and a recess positioned below the support member when the assembly is in the heating position to receive the second substantially enclosed portion of the flexible container, wherein the second substantially enclosed portion of the flexible container is thereby configured to receive the liquid byproducts given off by the food product in the first substantially enclosed portion of the flexible container in the recess.

2. The assembly of claim 1, further comprising an absorbent material in the second substantially enclosed portion of the flexible container.

3. The assembly of claim 2, wherein the absorbent material comprises a cellulose material.

4. The assembly of claim 1, wherein the connecting portion comprises a partial seal separating the first substantially enclosed portion and the second substantially enclosed portion of the flexible container.

5. The assembly of claim 1, wherein the package comprises a low thermal conductivity material.

6. The assembly of claim 5, wherein the low thermal conductivity material comprises a paperboard material.

7. The assembly of claim 6, wherein the package comprises a single piece of the paperboard material.

8. The assembly of claim 1, further comprising a cut-resistant coating on the support member.

9. The assembly of claim 1, further comprising an absorbent material in the recess.

10. The assembly of claim 9, wherein the absorbent material comprises a cellulose material.

11. The assembly of claim 1, wherein the assembly is configurable to a storage position, in which the support member at least partially defines a top portion of the package, and the flexible container is retained between the top portion and the base member.

12. The assembly of claim 11, wherein the support member at least partially defines a handle when the assembly is in the storage position.

13. The assembly of claim 1, further comprising a second support member coupled to the base member.

14. The assembly of claim 13, wherein the assembly is configurable to a storage position, in which the support member and the second support member at least partially define a top portion of the assembly, and the flexible container is retained between the top portion and the base member.

15. The assembly of claim 14, wherein the support member and the second support member define a handle when the assembly is in the storage position.

16. The assembly of claim 13, wherein the second support member defines a second surface, and wherein at least one of the surface and the second surface slopes toward the recess when the assembly is in the heating position.

17. The assembly of claim 13, wherein the recess is defined between the support member and the second support member.

18. The assembly of claim 1, further comprising a removable top portion, wherein the flexible container is retained between the removable top portion and the base member when the assembly is in a storage position.

* * * * *